US006814186B1

(12) United States Patent
Harbers, Jr.

(10) Patent No.: US 6,814,186 B1
(45) Date of Patent: Nov. 9, 2004

(54) HIGH EFFICIENCY BELAY APPARATUS

(75) Inventor: Henry C. Harbers, Jr., Templeton, CA (US)

(73) Assignee: Atoll Holdings, Inc., San Luis Obispo, CA (US)

( * ) Notice: Subject to any disclaimer, the term of this patent is extended or adjusted under 35 U.S.C. 154(b) by 0 days.

(21) Appl. No.: 10/278,410

(22) Filed: Oct. 22, 2002

Related U.S. Application Data

(63) Continuation-in-part of application No. 09/580,123, filed on May 30, 2000, now abandoned, which is a continuation-in-part of application No. 09/561,311, filed on Apr. 28, 2000, now Pat. No. 6,186,276, which is a continuation of application No. 09/126,652, filed on Jul. 31, 1998, now abandoned.

(51) Int. Cl.[7] ..... A62B 35/00
(52) U.S. Cl. ..... 182/231; 182/7
(58) Field of Search ..... 182/231, 236, 182/7

(56) References Cited

U.S. PATENT DOCUMENTS

| | | | |
|---|---|---|---|
| 421,115 | A | 2/1890 | Taylor |
| 441,819 | A | 12/1890 | Bresnahan |
| 662,243 | A | 11/1900 | Nelson |
| 1,113,369 | A | 10/1914 | Olson |
| 1,123,776 | A | 1/1915 | Meyer |
| 1,766,566 | A | 6/1930 | Tucker |
| 1,787,651 | A | 1/1931 | Zwink |
| 4,039,045 | A | 8/1977 | Hoger |
| 4,645,034 | A | 2/1987 | Griffith |
| 4,679,656 | A | 7/1987 | Lew et al. |
| 4,941,548 | A | 7/1990 | Blanchard |
| 4,997,064 | A | 3/1991 | Motte et al. |
| 5,186,275 | A | 2/1993 | Bajin |

*Primary Examiner*—Alvin Chin-Shue
(74) *Attorney, Agent, or Firm*—William W. Haefliger

(57) ABSTRACT

Apparatus for use in controlling vertical movement of a first weight, comprises a first element rotatable in one direction about an axis and blocked against rotation in the opposite rotary direction; a second element acting as a guide; a control weight; and lines supporting the first weight and control weight by the elements, and including a first line wrapping about the first element and a second line entraining the second element, whereby changes in force exertion on the control weight determine alternative existence of a first mode of operation wherein line slippage relative to the first element allows the first weight to descend, and a second mode of operation wherein line non-slippage relative to the first element thereby blocks descending of the first weight. In addition, the control weight is usable to exert force acting to remove slack from the second line, which is important for safety reasons, where the apparatus is used for climbing. Governor, hoist and other safety elements may be employed. A climbing pole is also provided for use in climbing in conjunction with operation of the elements, control weight and lines.

39 Claims, 12 Drawing Sheets

9
9a
494
320
322a
328
323a
322
323
380
323c
324
330
328
381
330b
330a
322c
350
370
302c
307a
303b
D
B
123
304
305,306
302c
123
111
307
9
9a

HIGH EFFICIENCY BELAY APPARATUS

This application is a continuation-in-part of U.S. patent application Ser. No. 09/580,123, filed May 30, 2000 abandoned, which is a continuation-in-part of Ser. No. 09/561,311, filed Apr. 28, 2000, now U.S. Pat. No. 6,186, 276, which is a continuation of Ser. No. 09/126,652, filed Jul. 31, 1998, abandoned.

BACKGROUND OF THE INVENTION

This invention relates generally to automatic belay apparatus and its use; and more particularly it concerns the provision of safe, easily used, simple and compact, fall protection/lowering apparatus which can be employed in many situations to save lives and also for recreational purposes.

There is a known phenomenon that when a rope is wrapped around a fixed cylinder an X tension is applied to one end of the rope, a reactive force less than X (we will call Y) will stop the rope from slipping. More wraps around the cylinder will reduce the required Y force necessary for equilibrium.

Once equilibrium is attained between X and Y, reducing Y force by some Δ amount will allow the rope to slip. The amount of reduction in Y is dependent upon, among other things, the elasticity of the rope, the number of wraps around the cylinder, the diameter of the cylinder, and the co-efficient of friction between the rope and the cylinder.

To belay in nautical terms, is to "make fast (a rope) by winding on a cleat or pin".

If one is climbing, to be belayed is to be protected (by a rope) from falling. This is accomplished by wrapping a rope around the belayer, or some other object, so as to reduce the Y tension when a climber falls, creating X tension. The governing equation depicting this phenomenon is:

| | | |
|---|---|---|
| X tension | = | $\theta^a$ F Y tension |
| Where $\theta^a$ | = | Number of degrees, in radians, that the rope is in contact with a fixed cylinder |
| F | = | Coefficient of friction between the rope and the cylinder |
| a | = | Rope coefficient |

Therefore, the greater number of wraps (radians), the lower Y is required for equilibrium.

And here is the paradox. If one wished Y to be minimal, multiple wraps are required; but, if one wishes to take up slack on the X rope when climbing by taking up Y tension, the weight of the rope X will be multiplied by the same factor (but in reverse) as when the climber falls which might make it impossible to take up slack, and hence a non-functional device.

As one example:

For a wire rope, with 5½ wraps around a 3" pipe (3.5 O.D.), $X$=50# and $Y$=0.12#

Therefore, the amplification factor is $$\frac{50\#}{.12\#} = 400$$

Now, remove the 49# weight leaving a 1# rope and try to pull Y. Y=1#×400=400# to take up slack. This is not possible, or practicable.

Accordingly, there is need for improved apparatus to overcome the above problem so that slack can be automatically taken up while using the multiplying effect of multiple wraps; and there is need for apparatus which can be easily used for safe lowering of weights, as from great heights.

SUMMARY OF THE INVENTION

It is a major object of this invention to provide improved fall protection/lowering apparatus and methods, meeting the above needs. Basically, the apparatus of the invention is used for controlling vertical movement of a first weight (as for example a human being or other load), and comprises:

a) a first element rotatable in one direction about an axis and a structure blocking said first element against rotation in the opposite rotary direction, b) a second element acting as a guide, c) a control weight, d) and lines supporting said first weight and control weight by said elements, and including a first line wrapping about the first element and a second line entraining the second element, whereby changes in force exertion on the control weight determine alternative existence of a first mode of operation wherein line slippage relative to the first element allows the first weight to descend, and a second mode of operation wherein line non-slippage relative to the first element thereby blocks descending of the first weight, e) and wherein i) the first line that wraps about the first element has line portions that extend downwardly to support loading imposed by the first weight and control weight, respectively, ii) the second line that entrains the second element has one line portion that extends downwardly to support control loading imposed proximate but independently of the first weight, and the one line portion not connected to the first weight, and another line portion to support loading imposed by the control weight.

Typically, the first line that wraps about the first rotor has line portions that extend downwardly to support loading imposed by the first weight and control weight, respectively; and the second line that entrains the second element also has line portions that extend downwardly to support loading imposed by the first weight and control weight respectively.

Another object is to provide a first rotor element with an extended surface to engage multiple, non-interfering wraps of the first line.

A further object is to provide the first rotor with two axially spaced generally conical portions, and a generally cylindrical portion intermediate those conical portions. Typically, the conical portions may have wrap engaging angularities characterized as maintaining the first line wraps free of sidewise interengagement or interference during operation of the apparatus to lower the first weight.

Accordingly, optimum operability and functioning of the first line and first rotor are maintained.

Yet another object is to provide the first rotor element with an axial through passage, the second line passing through that passage, whereby a high degree of compactness of the equipment is achieved.

An additional object is to provide support structure for a human being who imposes the first weight in order to be lowered, such support structure defined by an upright strut connected to the line wrapped about the first rotor, and a seating ledge connected to the strut. That ledge may advantageously include at least one folding section having an up-folded position extending generally parallel to the upright stem, and a down-folded position extending generally laterally to seat the human being.

In use, the first rotor, i.e. a cylinder for example, is allowed to rotate freely in one direction (while taking up slack), and prevented from rotating in the opposite direction while resisting a fall. The taking up of slack is accomplished by hanging a weight on the Y reactive side of the cylinder greater than the weight of the rope on the X tension side of the cylinder; hence, in the above one example, Y need only be 1# to take up slack but it is strong enough to resist a 400# load during a fall.

If the device is to be used by a climber, once the climber has climbed he must be able to lower himself. This can be accomplished by attaching a separate control rope to the Y reactive weight, running this control rope through the first rotor element, or over a freely rotating sheave, and then attaching the control rope to the X load. By shortening the control rope, the Y reactive force will be reduced until slippage occurs. Since X and Y will remain the same distance apart during slippage, slippage will continue unabated until the control rope is allowed to lengthen, for example lifted.

It is another object of the invention to provide a governor that engages a line to slow the rate of descent of the first weight as that rate of descent increases. As will be seen, one advantageous and simple governor includes at least two sheaves about which the line is entrained, together with relatively rotatable discs in a fluid medium, certain discs driven by the rotor to produce fluid shear acting increasingly to slow rotation of the rotor in response to increasing rates of rotation of the rotor and said certain discs. Accordingly the rate of descent of the weight can be slowed by controlling the rate of ascent of the control weight, as that rate tends to increase.

Yet another object of the invention is to provide a hoist to hoist weight of a line that extends between a control weight and the first rotor, thereby to eliminate or substantially reduce the effect of decreasing line weight on control of the system, as the control weight ascends (which makes the first weight fall faster). In this regard, the hoist may advantageously be very simply and effectively integrated with the governor; for example, a line may be entrained by two governor sheaves A and B; and a control line may be entrained by two hoist sheaves C and D; a primary axle may carry the A and C sheaves to rotate together; and a secondary axle may carry the B and D sheaves to rotate together.

A further object includes provision of a guide line having an upper portion that suspends the rotor about which the defined first line is wrapped, and at an upper location, the guide line also having a lower portion that is anchored at a fixed lower location. That lower portion can be released to permit bodily lowering of the rotor, as will be seen, whereby a climber or person whose weight is suspended by the rotor, can be safely lowered in an emergency. In this regard, the path of descent or ascent of the control weight can be guided by the guide line, angled so as not to interfere with the paths of ascent or descent of the person whose weight is suspended by the rotor.

An additional object includes provision of a slack detector engaging a portion of the line, below the level of the rotor; together with a signal generator to generate a detectable signal upon occurrence of slack in said engaged portion of the line. The slack detector may advantageously have first and second parts that are relatively movable in the direction of the line, the parts having associated grips to grip the line at locations spaced apart therealong, the signal generator (electrical or mechanical or other) being responsive to relative movement of such parts.

A further object includes provision of fin structure on the first rotor to act as a heat radiator during rapid slippage of the line in frictional wrapping or unwrapping engagement with the rotor, acting to generate heat.

Another object is to provide circularly spaced, axially extending protrusions on the first rotor, to be frictionally engaged by the first line wraps, to establish better control of wrap engagement with the rotor.

A yet further object is to provide apparatus for use in climbing of a pole, by a climber, and which includes a) a climber's harness for supporting the torso of a climber climbing the pole, b) first means for elevating that harness as the climber climbs the pole, and for blocking lowering of the harness, c) and second means carried by the pole for enabling climbing pull-up relative to the pole.

As will be seen, the second means may include a series of holes in the pole and spaced apart lengthwise of the pole to receive insertion of manually graspable pegs successively inserted into vertically successive holes. Typically, two of such pegs may be located respectively at opposite sides of the pole.

The first means referred to may include a) a first element including a rotor rotatable in one direction about an axis and blocked against rotation in the opposite rotary direction, b) a second element acting as a guide, c) a control weight, d) lines for supporting the climbers weight and the control weight by said elements, and including a first line wrapping about the rotor and a second line entraining the second element, whereby changes in force exertion on the control weight determine alternative existence of a first mode of operation wherein line slippage relative to the rotor allows the first weight (climber's weight) to descend, and a second mode of operation wherein line non-slippage relative to the rotor thereby blocks descending of the first weight.

Control means may be provided for supporting the rotor to be lowered relative to the pole, for safety purposes; and such control means may include a control line extending to a control location, to be extended for lowering the rotor relative to the pole.

These and other objects and advantages of the invention, as well as the details of an illustrative embodiment, will be more fully understood from the following specification and drawings, in which:

DRAWING DESCRIPTION

Figure 7:
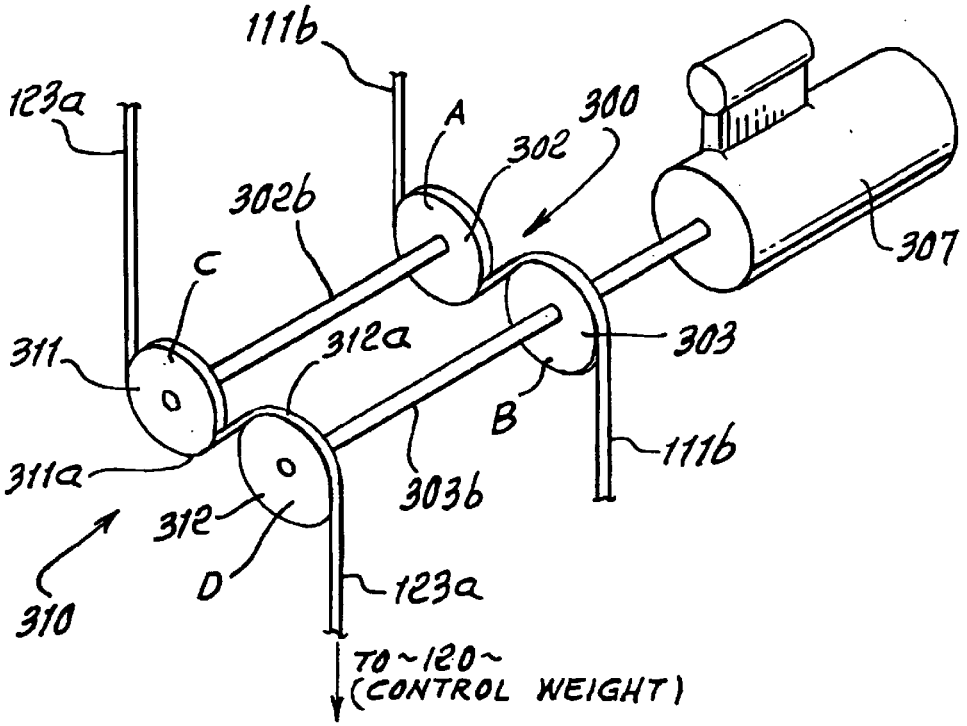
FIG. 7 is a schematic perspective view of a rate-of-descent governor integrated with a hoist mechanism.
Figure 7A:
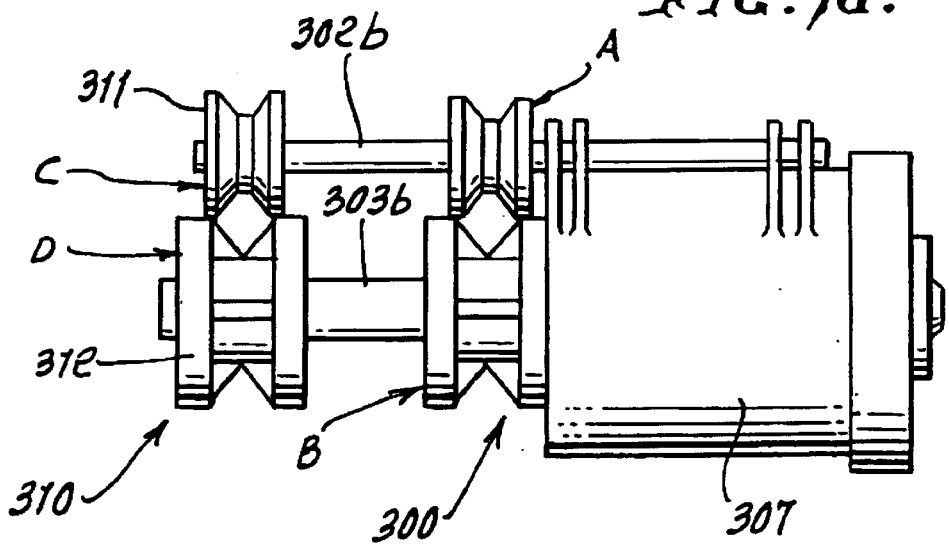
Figure 8:
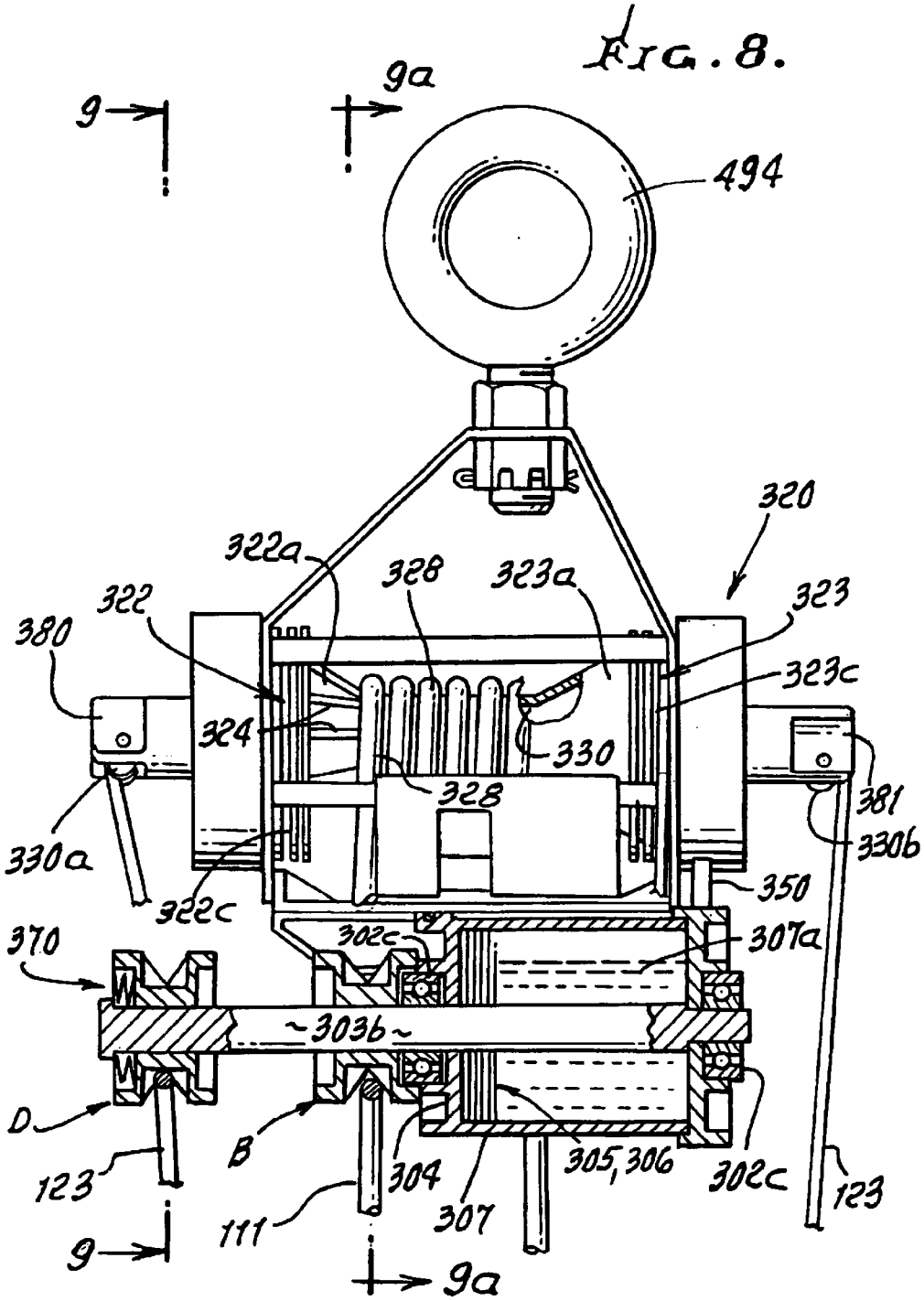
Figure 9:
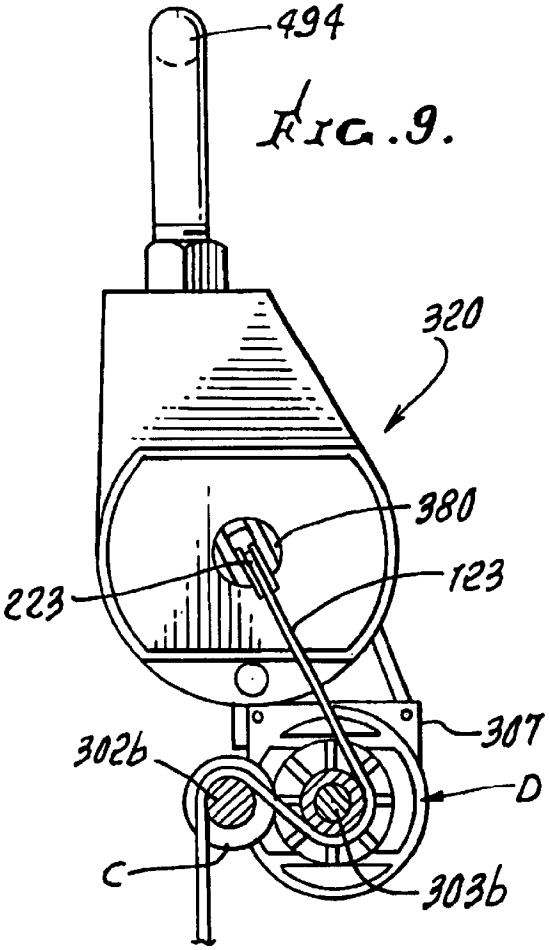
Figure 9A:
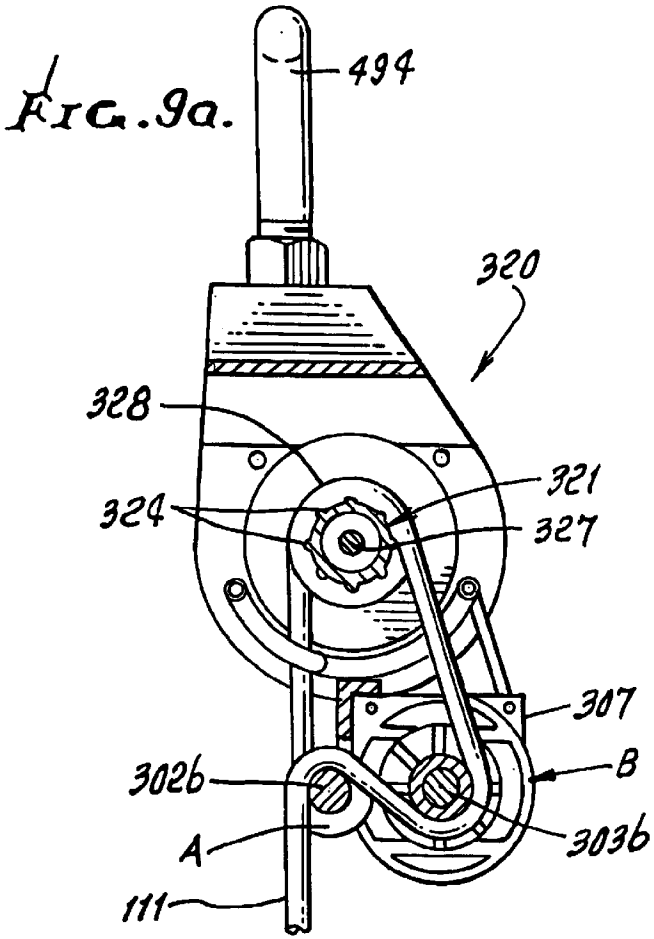
Figure 10:
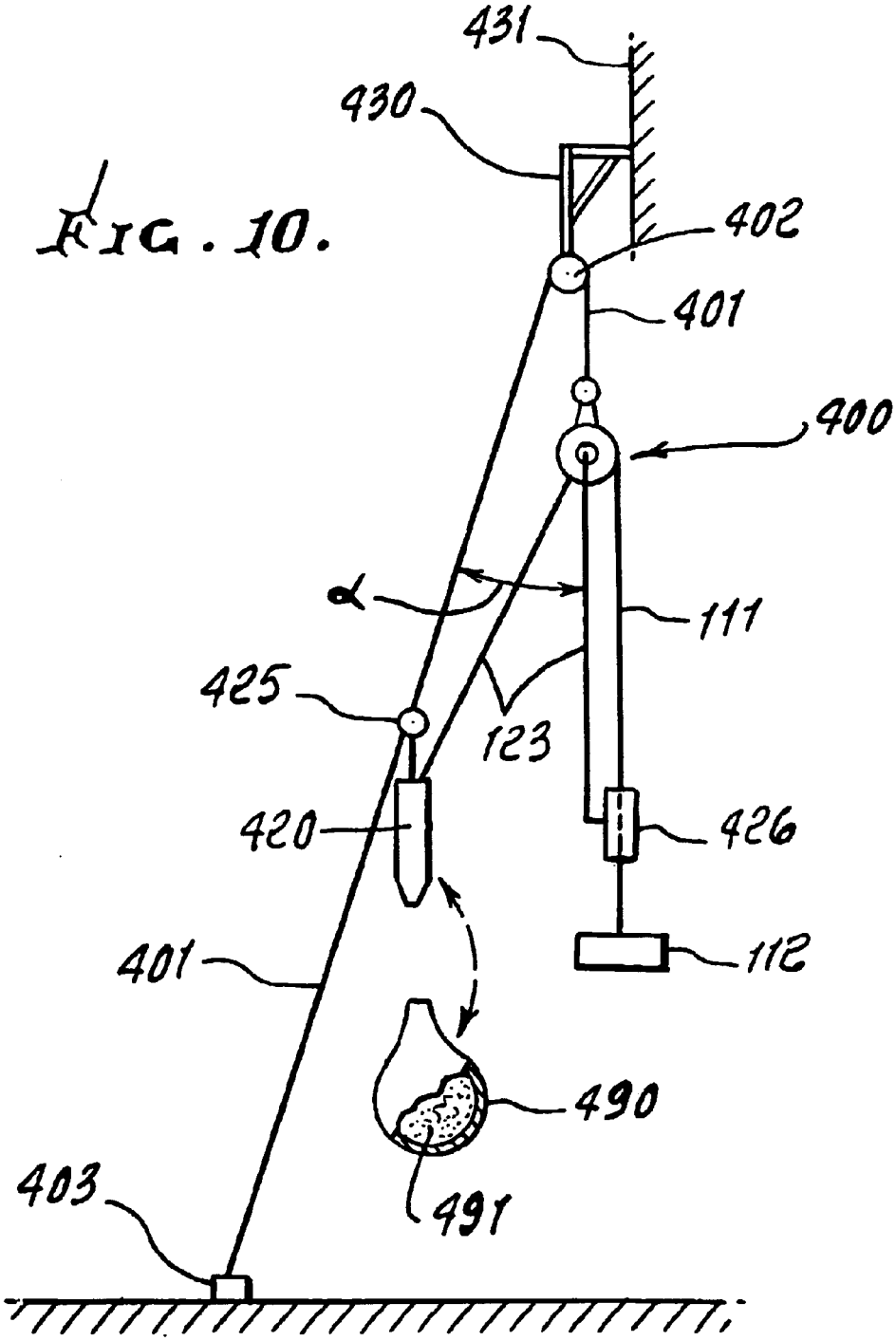
Figure 11:
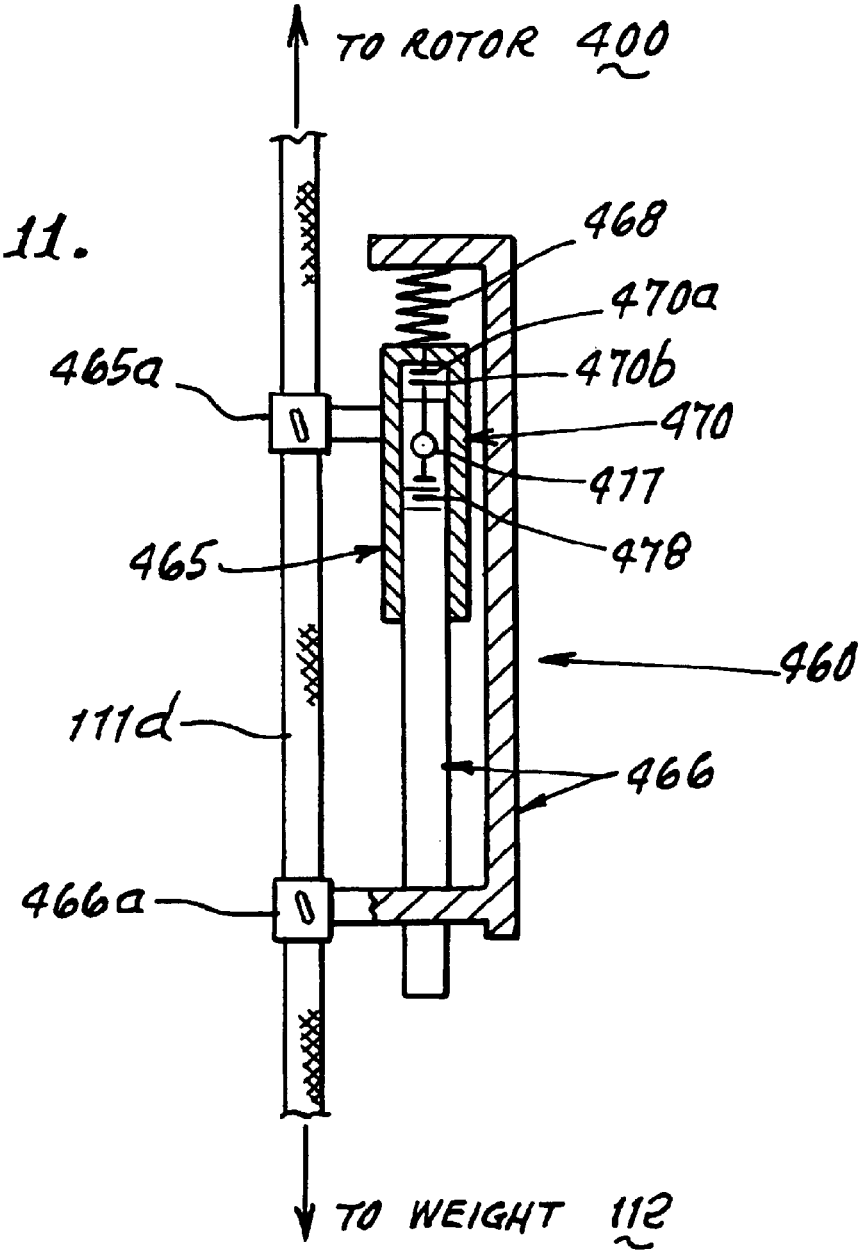
Figure 12:
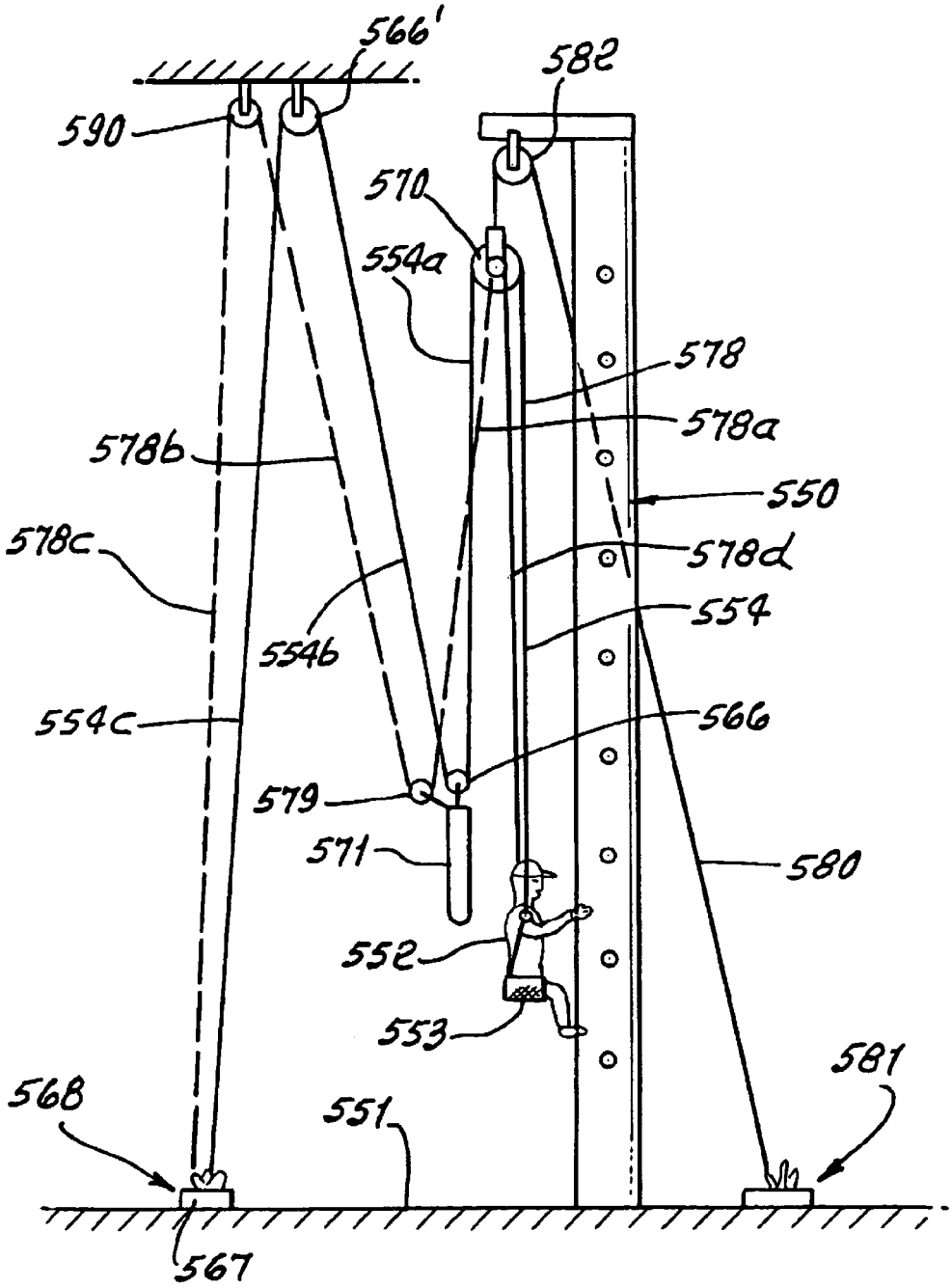
Figure 13:
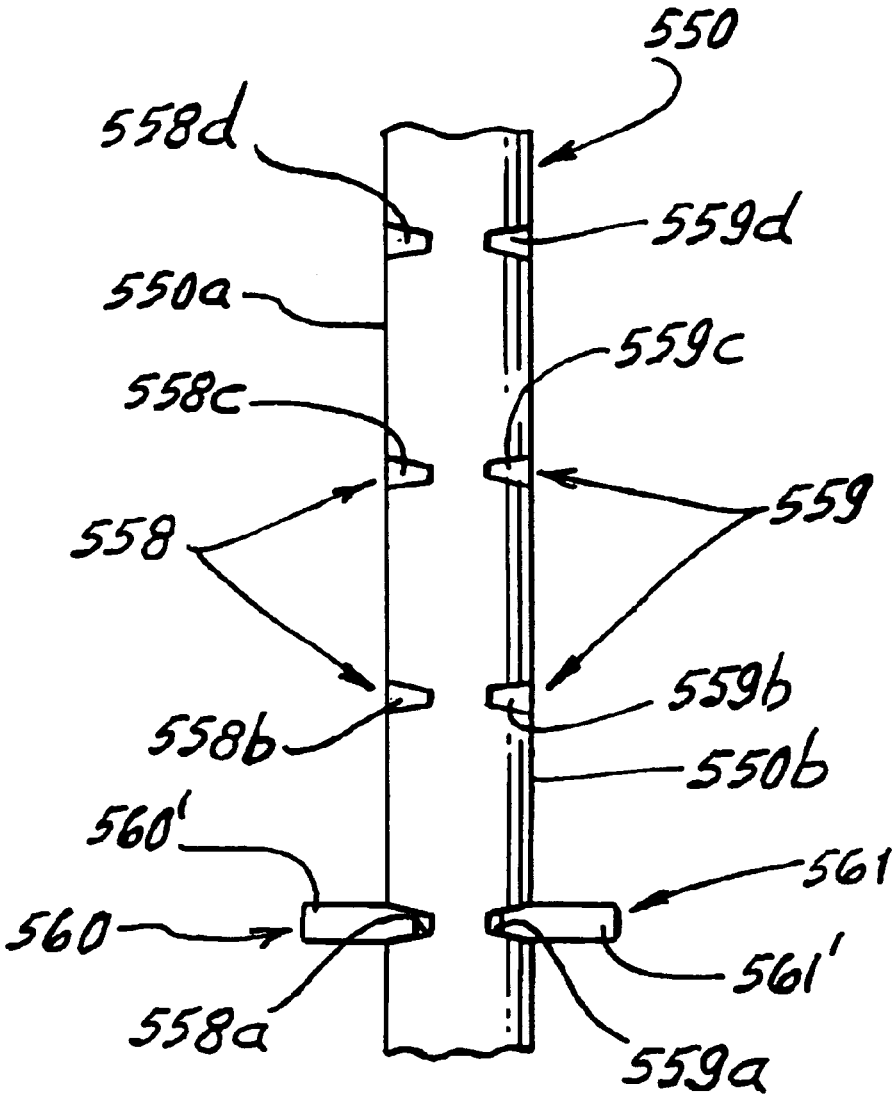

FIG. 7*a* is an elevation showing a governor of the type shown in FIG. 7;

FIG. 8 is an axial section taken through a governor as seen in FIG. 7*a*, and also through a rotor element entraining first line wraps, there being wraps shown as engaging protrusions on the rotor;

FIG. 9 is a section taken on lines 9—9 of FIG. 8;

FIG. 9*a* is a section taken on lines 9*a*—9*a* of FIG. 8;

FIG. 10 is a diagrammatic view showing the rotor element suspended by a hoisting line or rope, and enabling lowering of the rotor element and suspended climber;

FIG. 11 is a view showing a line slack detector connectible to a selected line;

FIG. 12 is an elevation showing a climbing pole and associated climbing apparatus; and FIG. 13 is an enlarged section showing climbing pegs inserted in, and successively insertible in, vertically spaced holes in the climbing pole.

DETAILED DESCRIPTION

Figure 1:
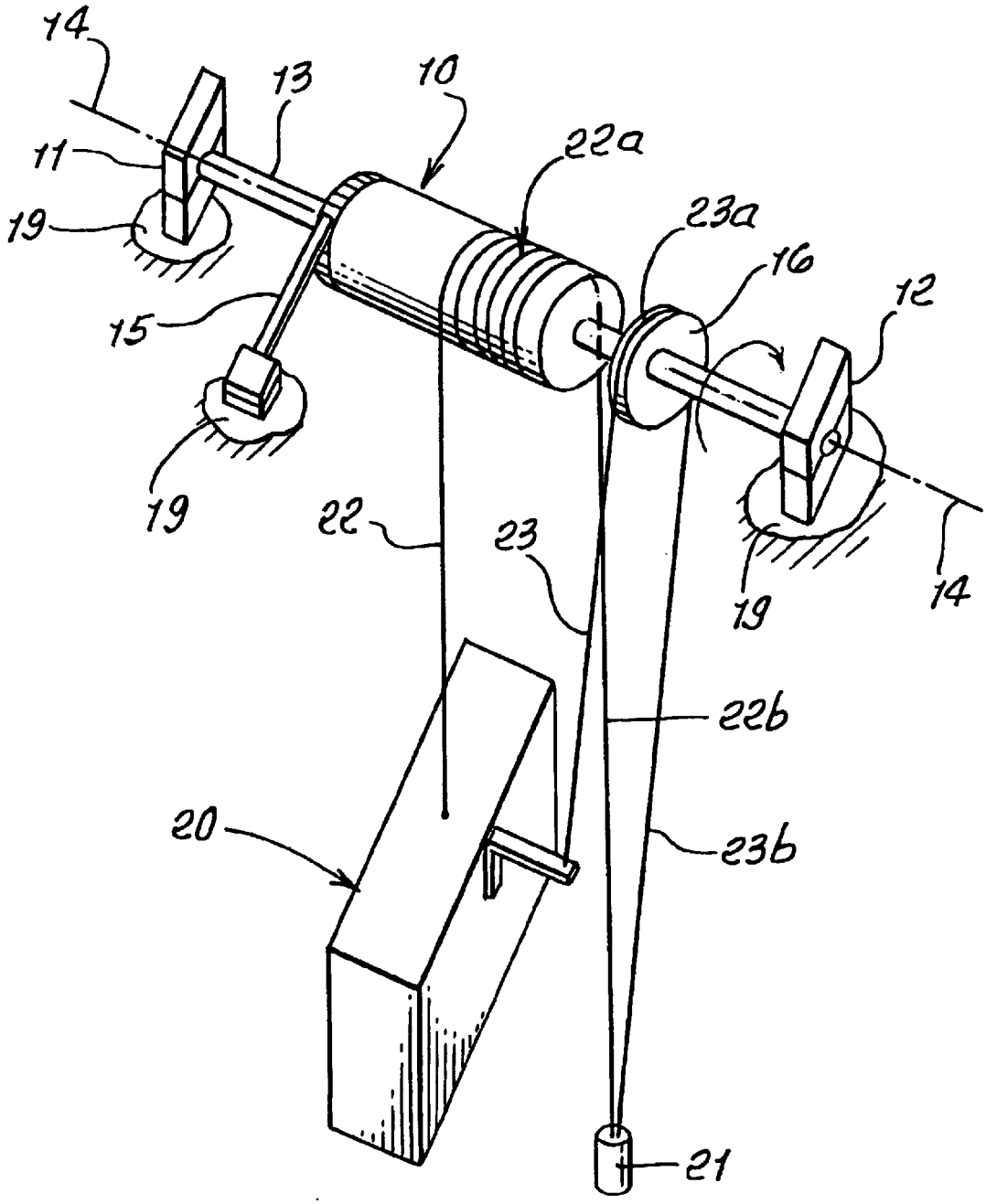
FIG. 1 is a perspective view of apparatus incorporating the invention.

In FIG. 1, a first load bearing rotor 10 such as a cylinder, is rotatable in one direction (clockwise, for example) but is blocked against rotation in the opposite rotary direction (counter-clockwise, as shown). Suitable bearing supports are shown at 11 and 12, to support the axle 13 supporting the rotor, and extending in the axial direction indicated at 14. A device to block counter-clockwise rotation may take the form of a ratchet arm 15 engaging ratchet teeth on the rotor. A suitable frame 19 supports 11, 12 and 15. Frame 19 may for example be attached to the outer side of a building.

A second rotor 16, such as a sheave or pulley, is supported to be freely rotatable in opposite directions about an axis. In the example, the rotor 16 may be carried by axle 13 to be freely rotatable about axis 14.

Two weights are supported by the two rotors. These include a first weight 20 and a control or reaction weight 21, the weights in this example hanging from the rotors, as via supporting lines. These include a first line 22 supporting first weight 20 and wrapping about the rotor at wrap locations 22*a* at which each turn of the wrap engages the rotor surface, line 22 then extending downwardly at 22*b* to assist in supporting the control weight 21. The lines also include a second line 23 extending downwardly toward the first weight 20, and also extraining the sheave at location 23*a*; line 23 then extends downwardly at 23*b* to assist in supporting the control weight 21.

Changes in force exertion determine alternative existence of a first mode of operation wherein line slippage relative to the first rotor allows the first weight to descend, and a second mode of operation wherein line non-slippage relative to the first rotor thereby blocks descending of the first weight.

By "shortening" the line 23 (for example by manually lifting line 23*b*) reactive force is reduced, until slippage of line 22 occurs at the wrap locations 22*a*, and slippage will continue, accompanied by lowering of first weight 20, until line 23*b* is allowed to "lengthen", i.e. eliminating or reducing manual lifting of line 23. Note that lines 22 and 23, near the weight 20, travel downwardly together during such slippage. Slippage at the wrap locations is prevented by friction, when the line 23 is "lengthened".

Table A below indicates that, depending upon the type of line (such as rope) and, the amount of weight "removed" as by lifting line 23*b* to allow slippage is affected by the number of wraps. (These results are results obtained for a selected set of rotors.)

TABLE A

Auto-Belayer Test 3.5" Steel Shaft
3.32" Wire Rope (1000 lb. cap.) weighing 0.015 lbs per foot.
1.4" Twisted Sisal Rope (45 lb. Working load Limit) weighing 0.015 lbs. per foot.
1.4" Twisted Nylon Rope (124 lb. Working Load Limit) weighing 0.012 lbs. per foot.
X = 50 lb. load.
Y = Weight to just Balance Load.
A = Amount of Weight removed from Y to allow slippage.
Wraps = Number of times the Material is around the Steel Shaft.
T = Time to fall 20" when Y made 0.0 lbs.

| Wraps | Material | X | Y | ^ | T |
|---|---|---|---|---|---|
| Wraps = 5 ½ | | | | | |
| | Wire Rope | 50 | .12 | .12 | 1.31 sec. |
| | Sisal | 50 | .36 | .24 | 4.37 sec. |
| | Nylon | 50 | .98 | .48 | 9.50 sec. |
| Wraps = 4 ½ | | | | | |
| | Wire Rope | 50 | .96 | .48 | .90 sec. |
| | Sisal | 50 | .96 | .24 | 3.00 sec. |
| | Nylon | 50 | 1.20 | .24 | 1.38 sec |
| Wraps = 3 ½ | | | | | |
| | Wire Rope | 50 | 1.44 | .48 | .40 sec. |
| | Sisal | 50 | 2.28 | .84 | 1.55 sec. |
| | Nylon | 50 | 3.41 | .48 | .38 sec. |
| Wraps = 2 ½ | | | | | |
| | Wire Rope | 50 | 4.18 | 1.5 | Fast |
| | Sisal | 50 | 6.0 | 2.3 | Fast |
| | Nylon | 50 | 7.11 | .50 | Fast |
| Wraps = 1 ½ | | | | | |
| | Wire Rope | 50 | 13.82 | 5.00 | Fast |
| | Sisal | 50 | 11.8 | 3.5 | Fast |
| | Nylon | 50 | 16.22 | 2.00 | Fast |
| Wraps = ½ | | | | | |
| | Wire Rope | 50 | 33.13 | 7.00 | Fast |
| | Sisal | 50 | 22.09 | 3.5 | Fast |
| | Nylon | 50 | 33.51 | 3.00 | Fast |
| Wraps = 5 ½ | | | | | |
| | Nylon | 50 | .48 | .48 | very slow movement |
| Wraps = 4 ½ | | | | | |
| | Nylon | 50 | 1.20 | .24 | very slow movement |
| | Nylon | 50 | 1.20 | 1.08 | 5 seconds per foot |
| | Nylon | 50 | 1.20 | 1.20 | 1 second per foot |

The following are four important features:

1. Increasing wraps around a cylinder will non-linearly increase the force amplification until it eventually reaches an asymptotic limit.
2. To take up slack, the cylinder must rotate in one direction while, acting as a force amplifier, it cannot be allowed to rotate in the opposite direction.
3. The type of rope combined with the number of wraps affects the lowering sensitivity.
4. A deadweight in series with the device on the Y reactive side can act to both protect the climber from a fall and control the rate of his descent.

Figure 2:
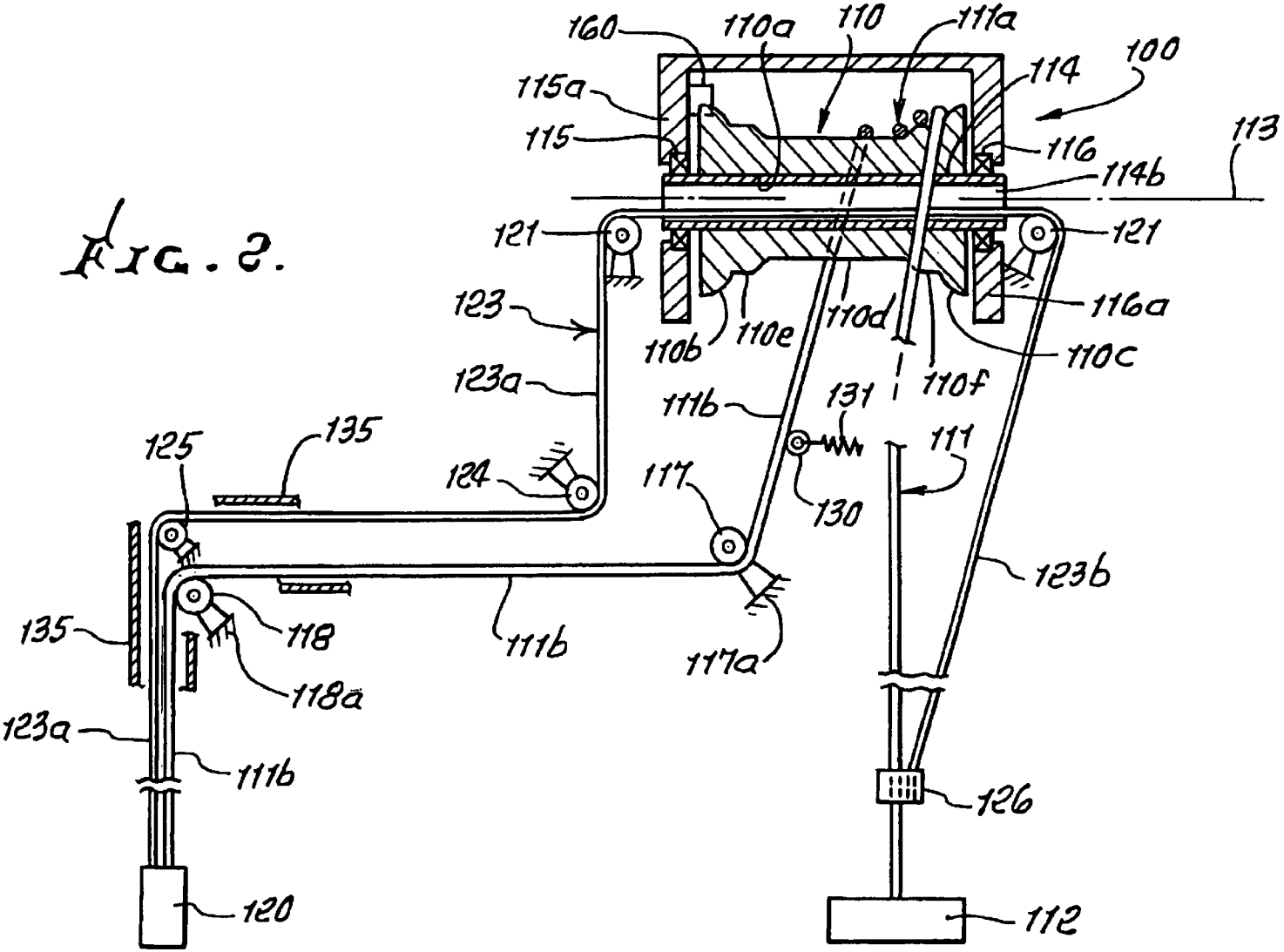
FIG. 2 is an elevation showing modified apparatus incorporating the invention.

Referring now to FIG. 2, showing modified and preferred apparatus 100, it includes a modified first rotor 110 about which a cable or line 111 is wrapped via multiple turns, at 111*a*. Line 111 extends downwardly to support a first weight 112 and may be operatively connected to the weight. The rotor 110 is shown as rotatable about a horizontal axis 113. The rotor has a through bore 110*a* through which a cylindrical duct 114 extends. The duct projects at opposite ends of the rotor and which may be supported by bearings 115 and 116 to allow free rotation of the rotor and duct about axis 113. Those bearings are carried by fixed walls 115*a* and 116*a*.

The opposite end extent 111*b* of line or cable 111 extends downwardly to a freely hanging control weight 120. The line 111*b* is shown as turned by pulleys or idlers 117 and 118, as shown, whereby control weight 120 may be located remotely from the weight 112. Fixed structure 117*a* and 118*a* supports the idlers.

A second rotor or rotors 121 is or are shown, as at the end or ends of the duct 114. A second cable or line 123 entrains the rotor or rotors 121. One end portion 123*a* of line 123 extends to control weight 120, and is turned via idlers 124 and 125 as shown. The opposite end portion 123*b* of the line 123 extends downwardly toward weight 112. Since the line 123 slidably extends through the interior 114*b* of the duct 114, and therefore through windings 111*a*, a very compact and simple assembly is provided, with lines 111 and 123*b* extending close to one another and almost directly downwardly toward the weight 112; also line extents 123*a* and 111*b* may extend close together toward the remotely located control weight, and within a protective duct 140, to shield lines 111 and 123*b* from the weather.

Raising or lowering of the line extent 123*b*, as via a control sleeve 126 extending about line 111 in proximity to weight 112, controls the rate of descent of the weight 112, as via control of control weight application to line extent 11*b*. Such control variations control the friction forces exerted by the multiple wraps at 111*a* on the surface of the rotor 110, which in turn controls the slippage rate. A ratchet is indicated at 160, for preventing reverse rotation of the rotor 110.

For enhanced control of such slippage, the first rotor 110 may be provided with two axially spaced generally conical surface portions 110*b* and 110*c*, and a generally cylindrical surface portion 110*d* intermediate the conical portions. The conical portions are interrupted by short cylindrical lands shown at 110*e* and 110*f*. It is found that such configurations serve to maintain the multiple wraps axially separated sufficiently as to avoid development of side-by-side rubbing of the multiple wraps. Such rubbing would otherwise interfere with accurate control of slippage of the wraps on the rotor. A means may be provided to urge line 111 leftwardly, to additionally assist in keeping the turns from side-by-side rubbing. Such means may comprise an idler 130 urged leftwardly as by a spring 131. Raising of weight 112 is associated with take-up of slack in line 123*b*, the importance of which is explained later, especially for safe climbing purposes.

Figure 3:
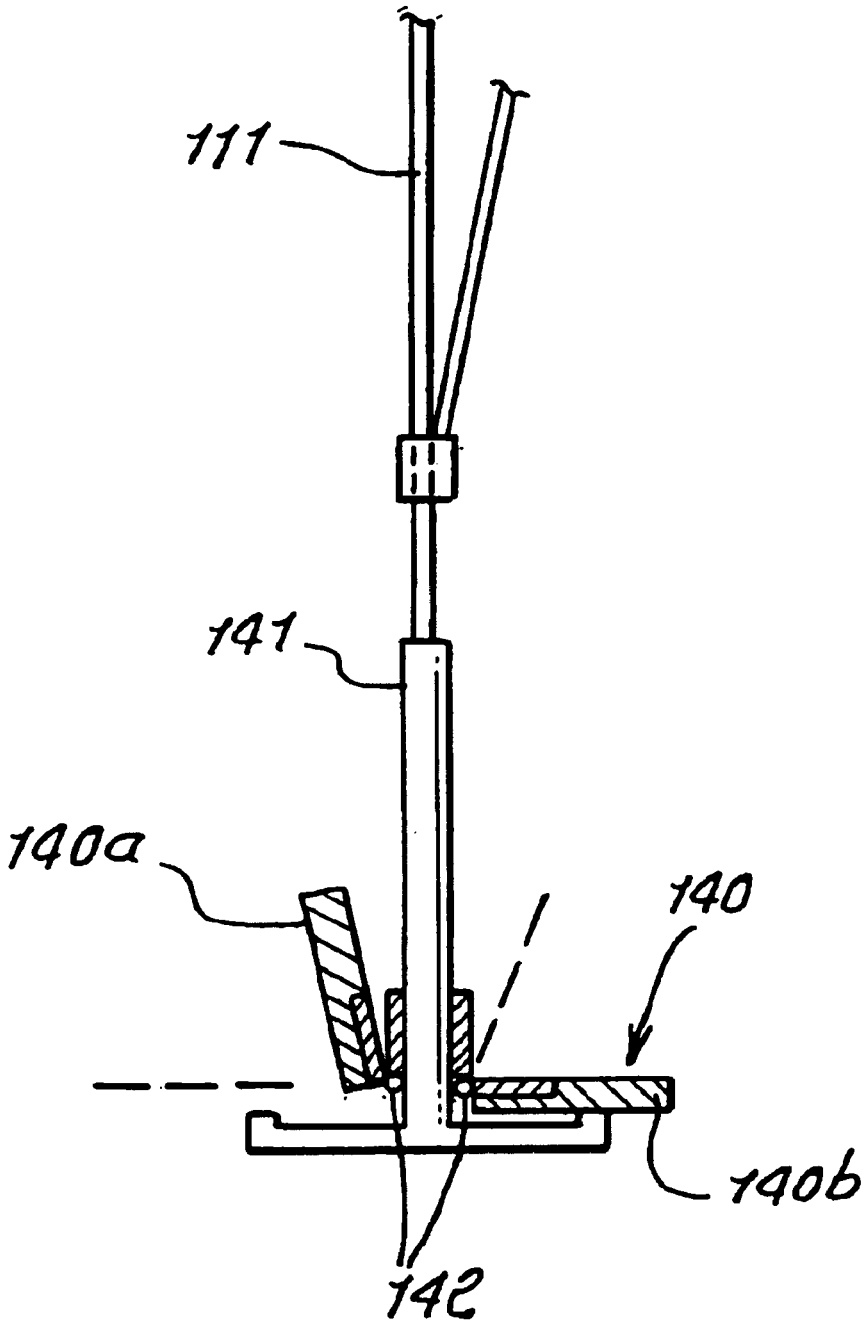
FIG. 3 shows a folding seat type support for a human who may wish to climb onto the seat as from a building window, and lower himself, safely, from a height, at the outer side of a building, using the apparatus as described.

A support may be provided for the weight 112 referred to, that support connected to at least one of the first and second lines. FIG. 3 shows the support in the form of a ledge 140 to seat a weight such as a human being. An upright strut 141 is connected to the ledge, and line 111 is shown connected to the strut. Ledge 140 is shown as including left and right sections 140*a* and 140*b* pivoted to the strut at 142, as by hinges. Accordingly, the seating sections 140*a* and 140*b* may be swung down to the section position 140*b* shown at such time as a human is to step onto the support to controllably and safely descend from a height, as at the outer side of a building, to escape from fire.

The rotors 121 may be non-rotary guides for line 123; and the bore of tube 114 may also or alternatively act as a line guide.

Figure 4:
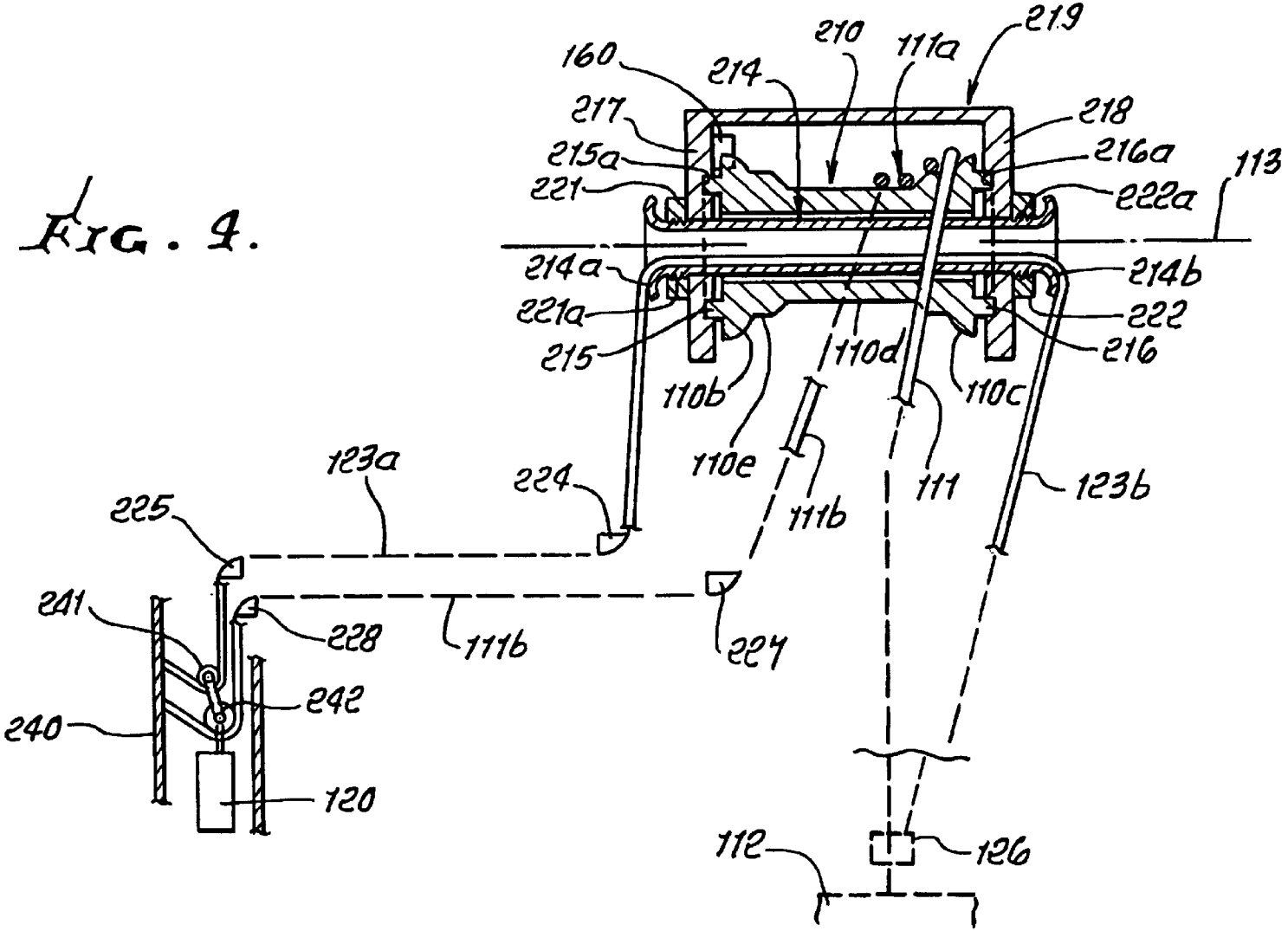
FIG. 4 is a view like FIG. 2, but showing further modified apparatus, which is preferred.

In the preferred apparatus of FIG. 4, the elements that remain the same as those in FIG. 2 carry the same identifying numerals. The rotor 210 (like rotor 110) has annular flanges 215 and 216 at its opposite ends, and which are received in annular grooves 215*a* and 216*b* in the fixed walls 217 and 218 of the frame 219. Those flanges or tongues rotate in the grooves about axis 113 as the rotor rotates, with loading transferred from rotor 210 to walls 217 and 218 via annular bearing surfaces provided at 215 and 215*a*, and at 216 and 216*a*. Surfaces 110*b*, 110*c*, 110*d* and 110*e* are the same as in FIG. 2, as are the line 111, wrappings at 11*a*, and line extent 111*b*.

Duct 214 is non-rotatable, and has its opposite ends clamped, via nuts 221 and 222 to the fixed walls 217 and 218. Those nuts have screw threaded attachment at 221*a* and 222*a* to the duct. Duct 214 serves as a guide or guide duct for the line section 223 passing through the duct, i.e. through windings 111*a*. The opposite end interior surfaces 214*a* and 214*b* are flared or turned, as shown, to act as slide guides for the line 223, to turn that line as shown, thereby eliminating need for the pulleys 121 as seen in FIG. 2. See also fixed, non rotary guides for the lines, at 224, 227, 228, and 225.

Protective duct 240 shields lines 123*b* and 111*b* from the weather. Pulleys 240 and 241 are carried by the control weight 220, to turn lines 123*a* and 111*b*, as shown, the ends of those lines being attached to 240. Therefore, weight 120 need only travel one half the vertical distance at it travels in FIG. 2, as weight 112 is lowered; and as it is raised. Raising of weight 112 is associated with lowering of control weight 120, which serves to take up slack in control line portions 123, 123*a* and 123*b*. This is important for example where the weight 112 is a human climber, climbing a wall or rock face, whereby he may use non-slack line 123*b* to control or stop a fall, immediately.

Figure 5:
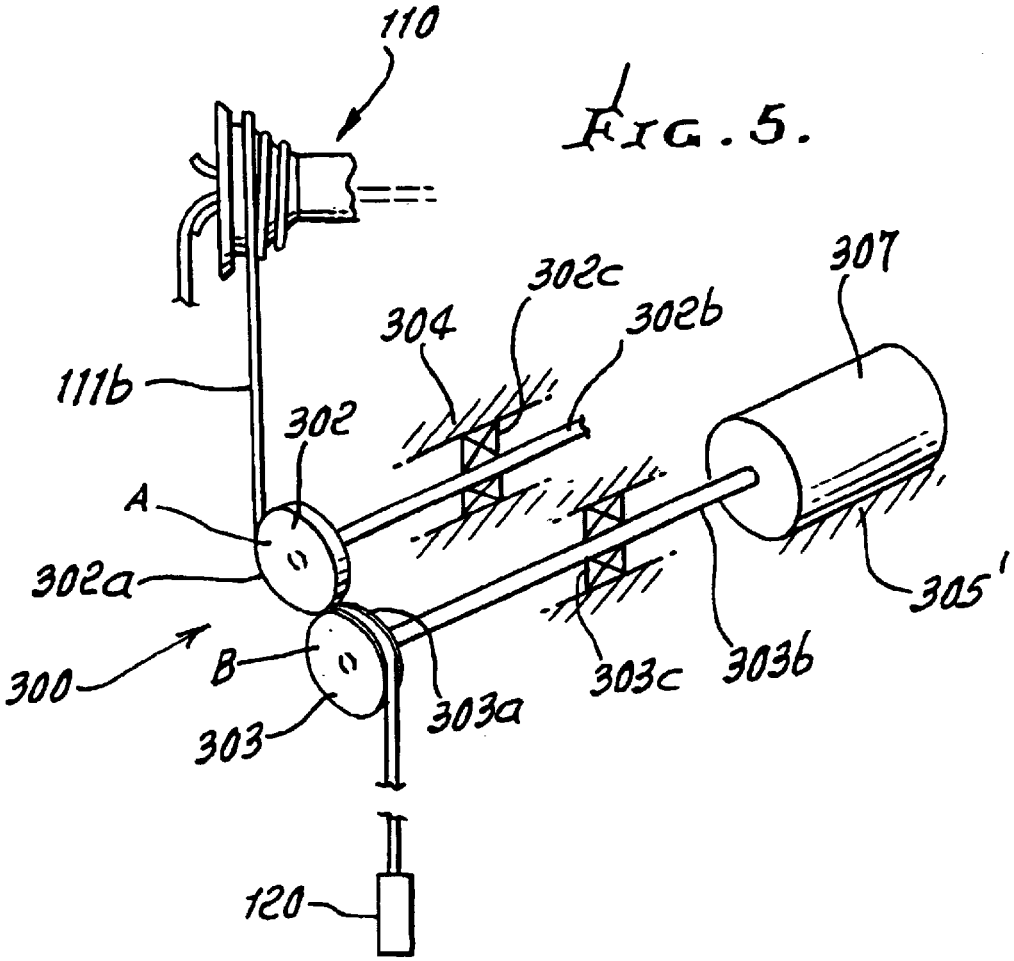
FIG. 5 is a perspective view showing a rate-of-descent governor, in schematic form.
Figure 6:
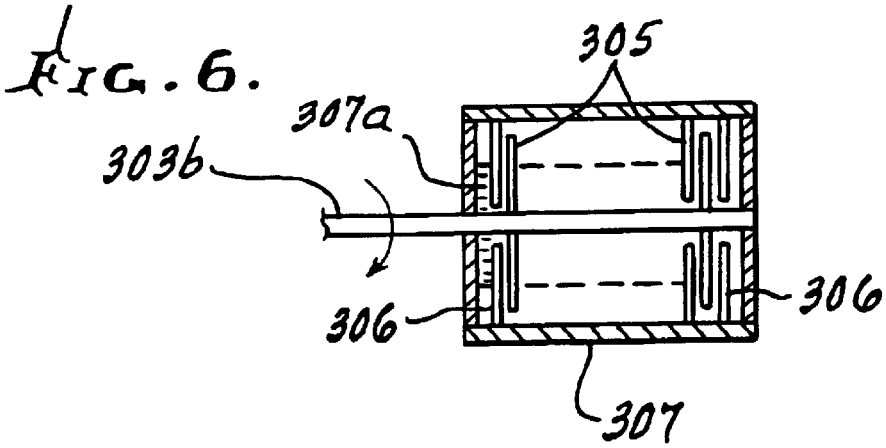
FIG. 6 is an axial section taken through a torque exerting brake employing rotary elements in a fluid.

Referring now to FIGS. 5 and 6, they schematically show provision of a control such as a governor 300, on the control weight side of the rotor, for slowing the rate of ascent of the control weight 120, as that rate increases, if and when such rate increase occurs. The governor is shown as engaging control line 111*b* to slow its ascent with weight 120.

A simple, effective governor includes at least two sheaves or pulleys 302 and 303, about which the line 111*b* is entrained, as at under and over sheave engagement zones 302*a* and 303*a*. The sheaves are carried by primary and secondary axles 302*a* and 302*b*, supported by structure 304 attached for example to the frame 305' that carries rotor 110. Suitable bearings may be provided as at 302*c* and 303*c*, whereby the sheaves are rotatable about parallel axes. The sheaves are otherwise indicated at A and B, as also represented in FIG. 7.

Rotation of one of the sheaves, as for example sheave B, is resisted, as by a restraint that increases as the line 111*b* rate of ascent increases, thereby to slow or control that rate of descent, of the weight 112, the objective being to prevent free-fall of the suspended weight or climber, in an emergency. As shown in FIG. 6, the resistance to rotation i.e. damping of sheave B and its axle 303*b* is suitably provided as by fluid shear, acting for example upon a disc or discs 305 connected to axle 303*b*. Discs 305 rotate closely adjacent and between fixed discs 306, within a housing 307 containing fluid 307*a* extending in the small gaps between discs 305 and 306. The fluid shear, produced in response to such relative rotation, acts increasingly to slow rotation of the rotor 303 in response to increasing rates of rotation of the rotor 303 and the discs 305.

Also shown in FIG. 7 is a reactive line hoist 310 operable to hoist weight of the reactive line 123*a* in the region below the rotor 210 and extending downwardly to control weight 120. The objective is to eliminate or reduce the effect of weight of the reactive line 111 upon the system. That effect would otherwise change as the control weight 120 moves upwardly, and would tend to unbalance the system if it were not counteracted.

The hoist 310 is shown as operatively connected, or integrated, with the governor, to simplify the overall apparatus. In the example, the hoist includes two sheaves or pulleys 311 and 312 about which reactive line 123*a* is entrained, as at under and over sheave engagement zones 311*a* and 312*a*. The hoist sheaves are shown as carried by the axles or shafts 302*a* and 303*a*, and are otherwise designated at C and D. Thus, primary axle 302*b* carries sheaves A and C to rotate, and secondary axle 303*b* carries the B and D sheaves to rotate. When control weight 120 is lifted by line 123*a* sheaves A and B rotate which will in turn lift the segment line 111*b* between the rotor and the control weight 120; hence, negating the weight of this rope segment upon the operation of the device when lowering weight 112. FIG. 7*a* is a side elevation view of an apparatus as shown in FIG. 7, and in greater detail. Note that B and D sheaves have greater diameters than A and C sheaves.

Referring now to FIGS. 8 and 9, they show a modified first rotor 320 having a cylindrical middle section 321, and opposite end sections 322 and 323 which have surfaces 322*a* and 323*a* which taper toward 321. Sections 322 and 323 are typically conical and hollow. The angularities of the surfaces of 322 and 323 are such as to maintain the first line wraps or turns 328 free of such sidewise interference, as would prevent free wrapping and unwrapping, during operation. Fins or discs are provided at 322*c* and 323*c* on the rotatable rotor, for dissipating heat generated by line wrap frictional engagement with the rotor, during slippage of the line wraps on the rotor.

Shallow ribs are shown at 324 in FIGS. 8 and 9*a* as protruding from only the conical surface 322*a* to be engaged by the first line wraps; the ribs extend generally longitudinally in the general direction of the rotor axis 327, and may have reduced height in a direction toward a mid-portion of the rotor. It is found that such ribs positively grip the line wraps 328, and prevent unwanted slippage. They also enhance the control amplification factor. The ribs are spaced about axis 327, as shown in FIG. 9. A suspension ring is shown at 494.

The rotor 320 has an axial through passage 330, for passing line section 223, as described above in connection with FIG. 4. Line turning sheaves are seen at 330*a* and 330*b*, and carried by rotor frame structures 380 and 381. A spring urged friction clutch 370 in FIG. 8 rotatably connects sheave D to shaft 330*b*, whereby the hoisting action can de-couple from shaft 303*b*, enabling control line 123 to be operated independently of hoisting action, below a selected level of hoisted weight.

Turning now to FIG. 10, it shows a rotor 400 suspended as by a guide or hoisting line 401 having an upper portion that extends upwardly over a pulley 402, and then downwardly at an angle $\alpha$ relative to vertical. Rotor 400 may correspond to any of the line wrapping rotors discussed above. A lower anchor at 403 releasably anchors the lower portion of line 401. Line 111 suspends the weight or climber 112, and wraps about the rotor 400. Control line 123 extends through the axial passage in the rotor, and then to control weight 420. The opposite end or tail end of line 123 extends downwardly to attach to the sleeve or control grip 426 through which line 111 extends. Line 111 also extends to the control weight, as in FIG. 4. The control weight 420 is guided by hoisting or suspending line 401 for up and down movement, lengthwise along line 401, i.e. away from the vertical up-down path of movement of the suspended weight or climber 112, so as not to interfere with movement of the latter. A ring 425 on the control weight 420 is shown as passing the hoisting line. In an emergency, the anchor at 403 can be released by another person to lower the suspended climber or weight 112.

The pulley 402 may be suspended at 430 as from a geologic formation face indicated at 431; or from a building proximate the exterior side of the building, also represented by 431. As stated, rotor 400 may take the form of any of the previously described rotors that suspend the weight or climber.

FIG. 11 shows a slack detector 460 for engaging a portion 111*d* of the first line between the rotor 400 and the suspended weight or climber 112, for detecting the occurrence of slack in that line, should it develop. The detector includes first and second parts 465 and 466 that are relatively movable in the direction of the first line. Those parts have associated grips, seen at 465*a* and 466*a*, to compressively grip the first line at spaced locations along its length. A compression spring 468 is located to urge the two parts in relative directions tending to urge the grips toward one another. If slack develops in the line 111, the grips gripping the line will then move relatively toward one another, and a signal generator responds to generate a detectable signal, such as an audible sound which the climber can hear, and/or which the person controlling the hoist or guide line 401 can also hear. That line can then be manipulated to lower the climber to safety. One signal generator is shown at 470 and comprises electrical contacts 470*a* and 470*b* movable together in response to relative movement of the two parts and grips. A switch is thereby closed to operate the sounder 477 in series with the contacts and a battery 478.

In FIG. 10, the control weight 420 can take the form of an alternative weight comprising a lightweight container 490 (such as a bag or sack) adapted to receive loose particles 491 such as sand, dirt, or gravel, at a climbing site. This avoids need to transport a solid control weight to the site.

The ratchet 160 may take the form of arcuate ramps terminating at blocking shoulders, on the end face of flange 320*a*, in FIG. 8

Referring now to FIGS. 12 and 13, a climbing pole is shown at 550 extending upwardly from the ground or support zone 551. A climber 552 is carried or attached to a harness 553 from which a line extends upwardly at 554 for supporting the climber, i.e. his torso or body, in association with his climbing the pole.

First means is provided for elevating the harness as the climber climbs the pole, and may be considered to include line 554. That first means is further characterized as blocking lowering of the harness, relative to the pole, during the climb. Second means is provided to be carried by the pole for enabling climbing pull-up by the climber, relative to the pole, as during the climb.

As shown in FIG. 13, that second means may preferably take the form of a series of holes in the pole and spaced apart lengthwise of the pole to receive insertion of manually graspable pegs successively inserted into vertically successive holes. See for example the vertically spaced holes 558 at one side 550*a* of the pole, and vertically spaced holes 559 at the opposite side 550*b* of the pole, the holes extending laterally into the pole as shown, preferably with taper. Typically, there are two of the pegs 560 and 561 located at said opposite sides of the pole, to project into the holes. The climber supported by his harness removes those pegs from lower holes 558*a* and 559*a* at one level and inserts them into the next above level holes 558*b* and 559*b*; he then pulls himself up by grasping the projecting extents 560' and 561' of the pegs and exerting lifting force to raise his body to a level enabling hand removal of the pegs from holes 558*b* and 559*b* and insertion of the removed pegs into the next above level holes 558*c* and 559*c*. This process of intermittent body lifting, and peg removal and insertion into successively next above holes, is repeated over and over to achieve the climb. During this process, the harness and its indicated elevating support means enables automatic harness elevation with the climbers torso or body (a control weight 571 then lowering); and also blocks lowering of the harness, for example until such lowering of the harness and climber is desired.

The structure associated with the harness for achieving such controlled harness movement preferably includes the following, considering that the climber's weight and associated weight of the harness is a "first weight":

a) a first element including a rotor rotatable in one direction about an axis and blocked against rotation in the opposite rotary direction, b) a second element acting as a guide, c) a control weight, d) lines supporting said first weight and control weight by said elements, and including a first line wrapping about the rotor and a second line entraining the second element, whereby changes in force exertion on the control weight determine alternative existence of a first mode of operation wherein line slippage relative to the rotor allows the first weight to descend, and a second mode of operation wherein line non-slippage relative to the rotor thereby blocks descending of the first weight.

Referring to the FIG. 12 example, the first element including the rotor is indicated at 570 the rotor for example taking the form of rotor 210 in FIG. 4; the second element acting as a guide may take the form of guide seen at 214 in FIG. 4. The control weight 571 corresponds to weight 120 in FIG. 4. The lines supporting the first weight (the weight of the climber 552) and the control weight 571 are indicated at 554, 554*a*, 554*b*, and 554*c*. First line 554 supports the first weight (the climber's weight) and wraps about the rotor to extend downwardly at 554*a* to a pulley 566 suspending control weight 571. Line 554*a* then extends upwardly at 554*b* and over a fixed position pulley 566' to then extend downwardly at 554*c* and terminate at a fixed support 567 at control station 568. A second line 578 entrains the guide at the rotor (for example passes through tubular part 214 seen in FIG. 4); line extension 578*a* then extends downwardly to pulley 579 on weight 571, then upwardly at 578*b* to fixed position pulley 590, and then downwardly at 578*c* and to the control station 568; and line extension 578*d* extends downwardly near the pole 550, to be manipulated by the climber.

This system blocks unwanted lowering of the climber, as during his climbing ascent, but enables controlled lowering of the climber, by his manipulation of line extension, hanging near the pole.

Also provided is a means for suspending and lowering the rotor 570, as during an emergency. See control line 580 extending downwardly to a control station 581, and extending upwardly over a fixed pulley 582 to support and suspend the rotor, as via rotor frame seen at 218 in FIG. 4. Control line 580 may be untied and payed out at station 581 to lower the rotor 570, and the suspended climber, as during such emergency.

I claim:

1. Apparatus used in controlling vertical downward movement of a first weight, comprising:

a) a first element rotatable in one direction about an axis and a structure blocking said first element against rotation in the opposite rotary direction, b) a second element acting as a guide, c) a control weight, d) and lines supporting said first weight and control weight by said elements, and including a first line wrapping about the first element and a second line entraining the second element, whereby changes in force exertion on the control weight determine alternative existence of a first mode of operation wherein line slippage relative to the first element allows the first weight to descend, and a second mode of operation wherein line non-slippage relative to the first element thereby blocks descending of the first weight, e) and wherein i) the first line that wraps about the first element has line portions that extend downwardly to support loading imposed by the first weight ii) and control weight, respectively, iii) the second line that entrains the second element has one line portion that extends downwardly to support control loading imposed proximate but independently of the first weight, and the one line portion not connected to the first weight, but extending near to the first line, and another line portion to support loading imposed by the control weight.

2. The apparatus of claim 1 including a support for the weight, and connected to at least one of the first and second lines.

3. The apparatus of claim 2 wherein said support has structure to support a human imposing said first weight.

4. The apparatus of claim 1 wherein said elements are rotors that have a common axis.

5. The apparatus of claim 1 in which the first element is a first rotor having an extended surface to engage multiple wraps of the first line, and the second element is associated with the first element.

6. The apparatus of claim 5 wherein the first rotor extended surface has two axially spaced generally conical portions, and a generally cylindrical portion intermediate said conical portions.

7. The apparatus of claim 6 wherein said conical portions have wrap engaging angularities characterized as maintaining the first line wraps free of sidewise interference during operation of said apparatus to lower said first weight.

8. The apparatus of claim 3 wherein said first weight support structure defines an upright medial strut and a ledge to seat a human being.

9. The apparatus of claim 8 wherein said ledge includes at least one folding section having an up-folded portion extending generally parallel to said upright stem, and a down-folded position extending generally laterally to seat the human being.

10. The apparatus of claim 1 including a support frame, the first element carried by said frame to rotate relative thereto, the second element associated with the frame.

11. The apparatus of claim 10 wherein the first element is a rotor, said rotor and the frame defining a tongue and groove annular bearing or bearings whereby the frame directly supports the rotor for rotation.

12. In combination with the apparatus of claim 1, said first element being a rotor having an extended surface, and rotatable about a first axis extending longitudinally, and including ribs protruding from said extended surface to be engaged by a first line, said ribs extending generally longitudinally and having progressively reduced height in a direction toward a mid-portion of said rotor.

13. The combination of claim 12 wherein said ribs are spaced apart about said axis.

14. The combination of claim 12, wherein said rotor extended surface has two axially spaced generally conical portions, and a generally cylindrical portion intermediate said conical portions.

15. The combination of claim 12 wherein said rotor has an axial through passage, and said second line passes through said passage.

16. Climbing apparatus in combination with the apparatus of claim 1, and which comprises, in further combination:

a) an upright climbing pole, in association with the line supporting the first weight, b) a climbing harness for supporting the torso of a climber climbing the pole, c) first means for elevating said harness as the climber climbs the pole, and for blocking lowering of the harness, d) and second means carried by the pole for enabling climbing pull-up relative to the pole.

17. The combination of claim 16 wherein said second means includes a series of holes in the pole and spaced apart lengthwise of the pole to receive insertion of manually graspable pegs successively inserted into vertically successive holes.

18. The combination of claim 17 wherein there are two of said pegs at opposite sides of the pole.

19. The combination of claim 16 wherein said first means includes a rotor, a line connected to said harness and to a control weight, said line entraining said rotor.

20. Apparatus used for controlling vertical downward movement of a first weight, comprising:

a) a first element rotatable in one direction about an axis and blocked against rotation in the opposite rotary direction, b) a second element acting as a guide, c) a control weight, d) and lines supporting said first weight and control weight by said elements, and including a first line wrapping about the first element and a second line entraining the second element, whereby changes in force exertion on the control weight determine alternative existence of a first mode of operation wherein line slippage relative tot he first element allows the first weight to descend, and a second mode of operation wherein line non-slippage relative to the first element thereby blocks descending of the first weight, e) said first element being a first rotor having an extended surface to engage multiple wraps of the first line, and the second element associated with the first element, f) said rotor extended surface having two axially spaced generally conical portions, and a generally cylindrical portion intermediate said conical portions, g) and wherein said first rotor has an axial through passage, and said second line passes through said passage.

21. Apparatus used in controlling vertical movement of a first weight, comprising:

a) a first rotor rotatable in one direction about an axis and blocked against rotation in the opposite rotary direction, b) a guide, c) a control weight, d) and lines supporting said first weight and control weight by said rotor and guide, and including a first line wrapping about the first rotor and a second line entraining the guide, whereby changes in force exertion on the control weight determine alternative existence of a first mode of operation wherein first line slippage relative to the first rotor allows the first weight to descend, and a second mode of operation wherein first line non-slippage relative to the first rotor thereby blocks descending of the first weight, the control weight acting to remove slack in the second line as the first weight rises, said guide defined by the rotor to have second line entrainment passage surface extent.

22. The apparatus of claim 21 wherein said guide comprises one of the following:

$x_1$ a sheave, $x_2$ a passage through the first rotor.

23. The apparatus of claim 21 including a protector extending about at least one of said lines extending upwardly from said control weight.

24. The apparatus of claim 21 including pulley means carried by the control weight and entraining said lines whereby travel of the control weight is reduced relative to travel of the first weight.

25. The combination of claim 21 including a protective duct extending about said control weight and the lines proximate the control weight.

26. Apparatus used for controlling vertical downward movement of a first weight, comprising:

a) a first element rotatable in one direction about an axis and blocked against rotation in the opposite rotary direction, b) a second element acting as a guide, c) control weight, d) and lines supporting said first weight and control weight by said elements, and including a first line wrapping about the first element and a second line entraining the second element, whereby changes in force exertion on the control weight determine alternative existence of a first mode of operation wherein line slippage relative to the first element allows the first weight to descend, and a second mode of operation wherein line non-slippage relative to the first element thereby blocks descending of the first weight, e) said first element being a first rotor having an extended surface to engage multiple wraps of the first line, and the second element being associated with the first element, f) and said first rotor having an axial through passage, and said second line passing through said passage.

27. Apparatus for use in controlling vertical downward movement of a first weight, comprising:

a) a first element rotatable in one direction about an axis and a ratchet blocking rotation in the opposite rotary direction, b) a second element acting as a guide, c) a control weight, d) and lines supporting said first weight and control weight by said elements, and including a first line wrapping about the first element and a second line entraining the second element, whereby changes in force exertion on the control weight determine alternative existence of a first mode of operation wherein line slippage relative to the first element allows the first weight to descend, and a second mode of operation wherein line non-slippage relative to the first element thereby blocks descending of the first weight, the first element being a first rotor having an axial through passage, and said second line passes through said passage, the first rotor having two axially spaced generally conical portions, and a generally cylindrical portion therebetween.

28. The apparatus of claim 27 including said support for the first weight, and connected to at least one of the first and second lines.

29. The apparatus of claim 28 wherein said first weight support has structure to support a human imposing said first weight.

30. The apparatus of claim 27 wherein said elements have rotor surfaces that have a common axis.

31. The apparatus of claim 27 wherein:

i) the first line that wraps about the first element has line portions that extend downwardly to support loading imposed by the first weight and control weight, respectively, ii) the second line that entrains the second element also has line portions that extend downwardly to support loading imposed by the first weight and control weight respectively.

32. The apparatus of claim 27 in which the first element is the first rotor having an extended surface to engage multiple wraps of the first line, and the second element is associated with the first element.

33. The apparatus of claim 32 wherein said conical portions have wrap engaging angularities characterized as maintaining the first line wraps free of sidewise interference during operation of said apparatus to lower said first weight.

34. The apparatus of claim 29 wherein said first weight support structure defines an upright medial strut and a ledge to seat a human being.

35. The apparatus of claim 34 wherein said ledge includes at least one folding section having an up-folded portion extending generally parallel to said upright stem, and a down-folded position extending generally laterally to seat the human being.

36. The apparatus of claim 27, including a support frame, the first element carried by said frame to rotate relative thereto, the second element associated with the frame.

37. The apparatus of claim 36 wherein the first element is a rotor, said rotor and the frame defining a tongue and groove annular bearing or bearings whereby the frame directly supports the rotor for rotation.

38. The apparatus of claim 27 wherein the force exertion on the control weight is by one of the following:

i) a person being allowed to descend, ii) a person at a control location, and not being allowed to descend.

39. Apparatus for use in controlling vertical downward movement of a first weight, comprising:

a) a first element rotatable in one direction about an axis and a ratchet blocking rotation in the opposite rotary direction, b) a second element acting as a guide, c) a control weight, d) and lines supporting said first weight and control weight by said elements, and including a first line wrapping about the first element and a second line entraining the second element, whereby changes in force exertion on the control weight determine alternative existence of a first mode of operation wherein line slippage relative to the first element allows the first weight to descend, and a second mode of operation wherein line non-slippage relative to the first element thereby blocks descending of the first weight, the first element being a first rotor having an extended surface to engage multiple wraps of the first line, and the second element is associated with the first element, the first rotor extended surface having two axially spaced generally conical portions, and a generally cylindrical portion intermediate said conical portions and wherein said first rotor has an axial through passage, and said second line passes through said passage.

* * * * *